US008496090B2

(12) United States Patent
Berends

(10) Patent No.: US 8,496,090 B2
(45) Date of Patent: Jul. 30, 2013

(54) VEHICLE ELEVATOR AND LIFT THEREIN

(75) Inventor: Jan Berends, Buitenpost (NL)

(73) Assignee: Stertil B.V., Kootstertille (NL)

( * ) Notice: Subject to any disclaimer, the term of this patent is extended or adjusted under 35 U.S.C. 154(b) by 759 days.

(21) Appl. No.: 12/305,562

(22) PCT Filed: Jun. 12, 2007

(86) PCT No.: PCT/NL2007/000147

§ 371 (c)(1),
(2), (4) Date: Feb. 24, 2009

(87) PCT Pub. No.: WO2007/148960

PCT Pub. Date: Dec. 27, 2007

(65) Prior Publication Data

US 2009/0205907 A1 Aug. 20, 2009

(30) Foreign Application Priority Data

Jun. 21, 2006 (NL) ..... 1032038

(51) Int. Cl.
*B66F 7/20* (2006.01)

(52) U.S. Cl.
USPC ..... 187/204

(58) Field of Classification Search
USPC ..... 187/204, 210, 211, 215, 216, 203
See application file for complete search history.

(56) References Cited

U.S. PATENT DOCUMENTS

| | | | | |
|---|---|---|---|---|
| 4,899,987 | A * | 2/1990 | Craig | 254/122 |
| 5,450,928 | A * | 9/1995 | Isogai | 187/205 |
| 5,613,575 | A * | 3/1997 | Ackermann | 187/211 |
| 6,070,699 | A * | 6/2000 | Bleeker | 187/240 |
| 6,186,279 | B1 * | 2/2001 | Blocker et al. | 187/206 |
| 6,213,451 | B1 * | 4/2001 | Finkbeiner | 254/124 |
| 6,966,873 | B2 * | 11/2005 | Oetlinger | 493/83 |

FOREIGN PATENT DOCUMENTS

| | | |
|---|---|---|
| DE | 29701732 U1 | 3/1997 |
| EP | 0983897 A2 | 3/2000 |

* cited by examiner

*Primary Examiner* — William E Dondero
*Assistant Examiner* — Michael Riegelman
(74) *Attorney, Agent, or Firm* — The Webb Law Firm

(57) ABSTRACT

The invention relates to a vehicle elevator, comprising: at least one carrier with a length direction for carrying a load thereon, such as a vehicle, and a lift under the carrier, which lift comprises at least two rotating components in a single line of assembly, wherein the rotating shaft extends along the line of assembly. The invention also relates to a lift for assembly in a vehicle elevator.

14 Claims, 2 Drawing Sheets

VEHICLE ELEVATOR AND LIFT THEREIN

BACKGROUND OF THE INVENTION

1.) Field of the Invention

The present invention relates to a vehicle elevator and a lift in or for such a vehicle elevator.

2.) Description of the Prior Art

It is known for such a vehicle elevator to comprise at least one carrier. Such a carrier has a length direction for carrying a load thereon. Vehicles can for instance be driven onto the carrier, or preferably carriers, of a vehicle elevator. The vehicles can then be displaced upward and then downward in order to create space under such a vehicle for maintenance and so on. For the purpose of lifting and/or lowering the carrier use is made in the known vehicle elevators of a lift. The lift is positioned under the carrier.

It is known to make use of diverse types of lift in such vehicle elevators. Use can for instance be made of scissor constructions and half-scissor constructions. In order to provide drive cylinders, pull rods and posts here in good and compact manner for desired operation of the lift, diverse configurations have already been proposed.

Reference is made by way of example to the disclosure of and in FIG. 7 of U.S. Pat. No. 6,213,451.

Diverse assembly elements are here provided on the underside of a carrier or wheel track. Each set of assembly elements serves to enclose therebetween an outer end of an element of the lift, such as a pull rod or a drive cylinder. Each outer end of each of these components must be bearing-mounted between the set of assembly elements, which in the known configuration takes the form of a steel plate or side plate welded on the underside of the wheel track. Furthermore, each outer end of these components must be movable or rotatable in a full range of movement.

Such a configuration has drawbacks.

Such drawbacks are for instance high vertical and horizontal forces on the assembly elements. The cylinder force can for instance amount to more than 40 tonnes, while the vertical load resting on the elevator is less than 10 tonnes. All assembly elements are individually loaded by this high load, whereby heavy wheel track reinforcements are necessary for attachment to the wheel track. In the existing embodiment this takes place by welding the assembly elements individually to the underside of the wheel track, wherein great specialist efforts are required to ensure alignment.

It is for instance necessary for many bearings to be provided for individual bearing-mounting of each of the outer ends of the diverse components of which the lift can consist. Many assembly operations also have to be performed in this respect for assembly of the vehicle elevator in question. There is moreover a further drawback that the sets of assembly elements are also aligned very precisely, this requiring great professional skill from for instance a welder for the purpose of arranging the assembly elements. It is the case here that each set of bearings for each outer end of the components must be sufficiently heavy to allow (rotation) movements of the components within a full range of movement under the heavy loading thereof. This results in a high degree of wear, since this wear is related to movement distances multiplied by the magnitude of the load.

The present invention has for its object to obviate, or at least reduce, the drawbacks of a configuration according to the known art.

SUMMARY OF THE INVENTION

Provided for this purpose according to the present invention is a vehicle elevator and a lift therefor, wherein the lift comprises at least two rotating components in at least one line of assembly. The rotating components are mounted together on a bearing-mounted rotation shaft extending along the line of assembly.

It is thus possible, instead of using diverse sets of assembly elements, to make use of a single set of assembly elements and associated bearing for the purpose of assembling the lift and the carrier, particularly by means of the rotation shaft. Only vertical loading forces are thus generated, this being favourable for the durability of the vehicle elevators according to the present invention. In addition, a great deal of time and money is saved in assembly, and errors in the alignment of sets of assembly elements can be avoided.

The invention has diverse preferred embodiments as defined in the dependent claims.

Already stated is that the lift is possibly a half-scissor construction. Use can be made therein of extensible drive elements and pull rods, preferably in combination with a post. It is possible here in very simple and elegant manner to design the extensible drive elements as a drive cylinder. This is for instance a hydraulic cylinder.

In a particularly advantageous preferred embodiment the vehicle elevator according to the present invention can have the feature that a slide block is arranged on the outer end of the post directed toward the carrier. Such a slide block can be enclosed in a profile or in a guide track which can be provided on the underside of the carrier for the purpose of guiding the movement of the relevant end of the post. Such a guide track will then be located at a distance from the line of assembly or the rotation shaft. It is however hereby possible to make a subassembly which substantially comprises only the lift. Other measures can however also be taken for this purpose. The slide blocks can in any case be inserted into the guide track and the rotation shaft having the at least two rotating components thereon can then be coupled to the carrier, preferably via the assembly elements to which the rotation shaft can then be coupled. Particularly when the guide track is here open at the outer end directed towards the line of assembly, a slide block can be readily inserted into the guide track at the relevant outer end of the post. A simple assembly can thus be realized. A lift can also be easily exchanged or replaced in a configuration according to the invention.

In yet another preferred embodiment one, or more than one, bearing block is arranged pre-mounted on either side of the rotation shaft. This also contributes toward being able to provide a subassembly which can form the lift for the vehicle elevator. A particular advantage of such a subassembly is that exchanging a lift can also take place in simple manner by detaching the rotation shaft and subsequently disassembling the vehicle elevator simply by sliding it out. A new lift can then be placed and mounted once again as subassembly so that the vehicle elevator can then be quickly taken into use again. Only the rotation shaft need be fixed again; the slide blocks need only be pushed or inserted into the guide tracks.

This further results in great freedom in assembling a vehicle elevator from one, or more than one, carrier and in herein choosing a lift with a desired lifting height suitable under the circumstances of use. Any random desired lift can then be mounted under any carrier.

BRIEF DESCRIPTION OF THE DRAWINGS

For a better understanding of the present invention a specific embodiment thereof will be described hereinbelow with reference to the accompanying drawings. In the drawings the same or similar parts and components are designated with the same reference numerals. In the drawings.

DETAILED DESCRIPTION OF THE PREFERRED EMBODIMENTS

Figure 1:
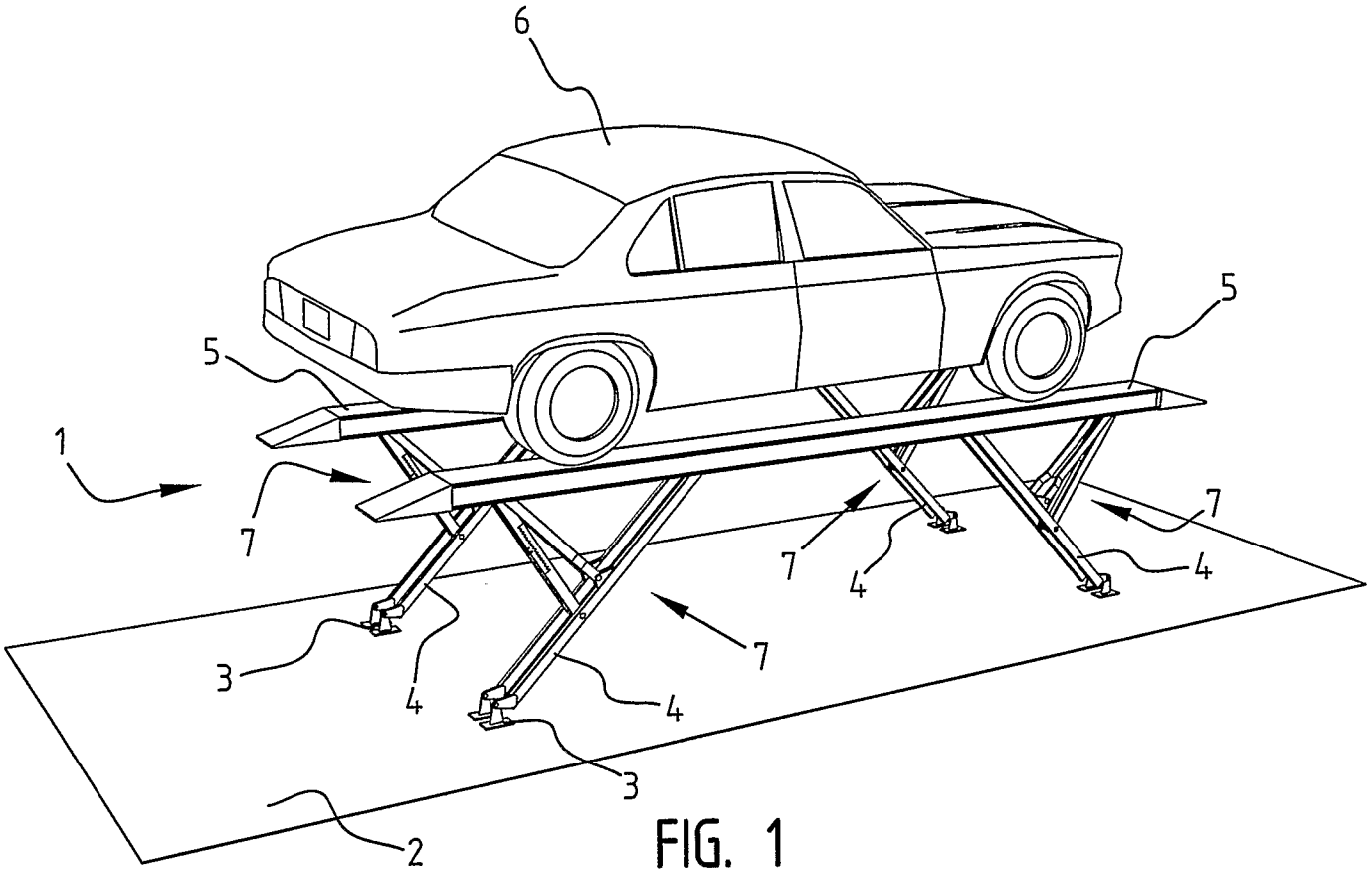
FIG. 1 shows a perspective view of a vehicle elevator according to the present invention in operation.

FIG. 1 shows a vehicle elevator 1. Vehicle elevator 1 is placed on a ground surface 2 using a number of feet 3.

A post 4 is mounted on each of the feet 3. Each post 4 comprises an assembly of two profiles 8 per post 4 with a small space between profiles 8. Posts 4 are arranged pivotally on feet 3. Pairs of posts 4 support in each case per couple a carrier designed as wheel track 5. Two wheel tracks 5 are thus provided in vehicle elevator 1.

A car 6 or other vehicle can drive onto wheel tracks 5 when wheel tracks 5 are situated on ground surface 2. Wheel tracks 5 must for this purpose be displaced downward relative to the situation shown in FIG. 1.

Use is made for this purpose of the lifts designed as half-scissor constructions 7.

Figures 2, 3:
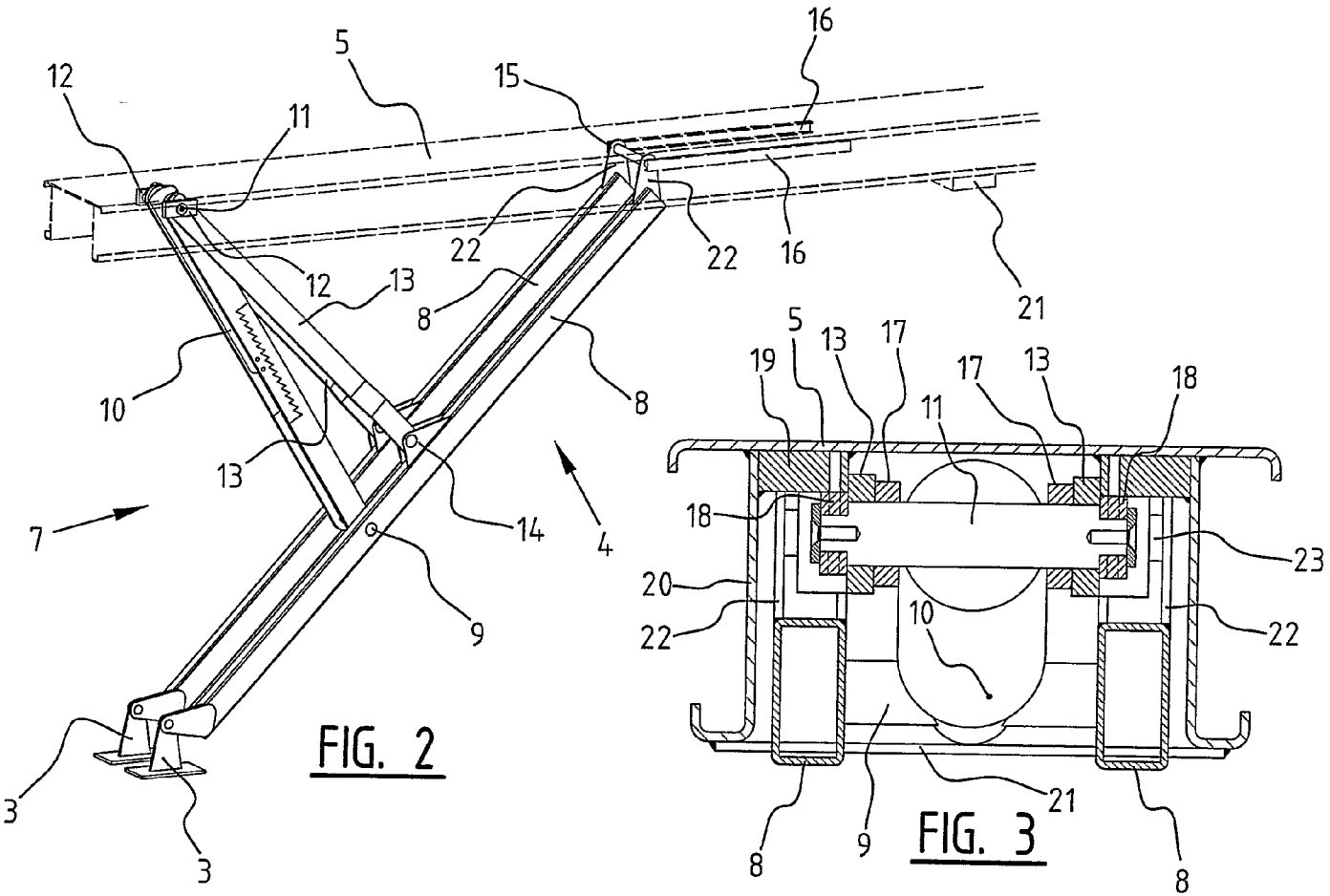
FIG. 2 shows a detail of a lift of the embodiment of FIG. 1.
FIG. 3 shows a cross-sectional view through a carrier with a lift thereunder in a collapsed position of the vehicle elevator in the embodiment of FIG. 1.

FIG. 2 shows a single half-scissor construction 7 together with a part of wheel track 5 which is shown in broken lines and under which the half-scissor construction 7 is arranged. The post 4 of the half-scissor construction 7 comprises the individual profiles 8 which are each mounted pivotally on feet 3. A limited space is thus available between profiles 8. Mounted in this space between profiles 8 of post 4 is a rotation shaft 9 on which engages a drive element in the form of hydraulic cylinder 10. At the opposite end hydraulic cylinder 10 is fixedly mounted on a rotation shaft 11 which extends between two mounting plates 12 and is connected thereto by means of bearings 11.

Two pull rods 13 are arranged rotatably on the same rotation shaft 11 on either side of cylinder 10. Pull rods 13 extend from rotation shaft 11 to mounting points 14 on profiles 8 of post 4. Pull rods 13 are bearing-mounted in mounting points 14.

Because pull rods 13 are bearing-mounted on rotation shaft 11, the range of movement thereof relative to shaft 11 is considerably smaller, and lighter bearings can be applied in combination therewith than in the case that pull rods 13 are mounted between side plates or plates (the full range of movement). During rotation about the rotation shaft the bearings are for instance rotated not through 55° but only through for instance 15°.

Slide blocks 15 are arranged on the outer ends of profiles 8 of post 4 opposite feet 3. Slide blocks 15 drop into mutually opposite profiles 16 forming C-shaped or L-shaped guide tracks. Profiles 16 can be arranged, in particular welded, against or on the surfaces of L-shaped profiles 20 directed toward each other.

Slide blocks 15 are reciprocally slidable along the maximal length of profiles 16.

When hydraulic cylinder 10 is energized and hydraulic fluid is fed thereto, the distance between rotation shaft 11 and rotation shaft 9 is made larger, while the distance between rotation shaft 11 and mounting points 14 remains the same. The post is thus forced to rotate about rotation points in feet 3, the post rotates about mounting points 14 and slide blocks 15 slide in guide tracks 16, to the left in the drawing of FIG. 2.

The position of the half-scissor construction 7 as shown in FIGS. 1 and 2 is thus reached. If cylinder 10 is then allowed to be emptied again, for instance under the influence of the weight of vehicle elevator 1, optionally with a vehicle 6 thereon, the collapsed position is reached with wheel track 5 close to the ground surface, or even flat against it.

A cross-sectional view of a further developed embodiment is shown in FIG. 3 in such a collapsed position of vehicle elevator 1. This shows the compact manner in which a vehicle elevator 1 designed according to the present invention, in particular a half-scissor construction 7 thereof, can be folded down.

Cylinder 10 is arranged fixedly on rotation shaft 11. In addition, locks 17 are arranged. These enclose pull rods 13, each against a bearing block 18, for rotation about rotation shaft 11. Bearing blocks 18 are arranged against supports 19, of which the mounting plates 12 described above with reference to FIG. 2 can form part and which are fixed under wheel track 5, for instance by being welded against side profiles 20 of wheel track 5.

FIG. 3 further shows the profiles 8, in particular tubular profiles, which form posts 4. At a distance therebehind can also be seen a strengthening element 21, which is also shown in FIG. 2. This strengthening element 21 extends between side wall profiles 20 of wheel track 5.

Further shown is that extension pieces 22 are arranged on tubular profiles 8, between which pieces runs a connecting shaft 23. This is however only optional; profiles 8 can also continue as far as slide blocks 15.

The slide blocks 15, which are not shown in detail in FIG. 3, are arranged on the outer end of tubular profiles 8 shown in FIG. 2.

The configuration shown in more detail in FIG. 2, and in particular in FIG. 3, comprises half-scissor constructions 7 which can serve as subassembly. This means that only the rotation shaft 11 and the coupling of posts 4 to feet 3 have to be released to enable release of a lift formed by such a half-scissor construction 7 for maintenance or replacement. The reverse is also the case, that assembly of a thus formed lift can be effected in simple manner. For this purpose slide blocks 15 have to be guided into the guide tracks formed as L- or C-profiles 16, whereafter rotation shaft 11 and the connection to feet 13 can be energized or created for mounting of the half-scissor construction 7.

Additionally or alternatively, an embodiment which is very favourable in respect of assembly can be provided in which adjusting plates (not shown) can be arranged transversely under the wheel track 5 or carrier. Such adjusting plates are preferably arranged in the vicinity of rotation shafts 11 at the outer ends of wheel track 5. It is important that the adjusting plates are placed and mounted or welded as well as possible transversely of the lengthwise direction of wheel track 5. The adjusting plates can then serve as alignment for side wall profiles 20 of wheel track 5 where these side wall profiles 20 are positioned so as to lie against the adjusting plates which are then arranged at the outer ends of wheel track 5, whereafter side wall profiles 20 can be fixed under wheel track, in particular welded thereto. The C-shaped or L-shaped profiles 16 can then be placed or welded relative to side wall profiles 20, as can supports 19, in order to have bearing blocks 18 lie against supports 19 and then fix these supports. Supports 19 can also be omitted so that—in the absence thereof—the bearing blocks can be mounted directly against the adjusting plates, for which purpose it may be found necessary to modify the dimensioning of the bearing blocks. This results in a very advantageous manner of assembling the wheel tracks, and at the same time a certain alignment of the elements thereof for accommodation therein of the lift.

More alternative and many additional embodiments are possible within the scope of the present invention, although only one specific embodiment has been described in the foregoing with reference to that shown in the accompanying drawing. These additional and alternative embodiments must all be deemed as lying within the scope of the present invention as defined in the appended claims. It is thus possible to use a full scissor construction instead of a half-scissor construction 7. It is however the case here that more floor area under vehicle elevator 1 is used to create or provide the same number of lifts. The driving can be realized in random manner other than by using hydraulic cylinder 10. It is thus possible for use to be made of an electric motor, for instance in combination with a jack or other similar construction. FIG. 1 shows that feet are used on a ground surface as structural base for the lifts of the vehicle elevator. It is on the other hand also possible within the scope of the invention to recess such bases into the ground surface. Tubular profiles 8 can be further strengthened, particularly with a connecting beam therebetween for the purpose of holding the profiles 8 parallel, which beam can be arranged particularly above the mounting points 14 in FIG. 2. Strengthening can also be arranged at rotation shaft 9 and/or at mounting points 14. This lies within the reach of the skilled person, and depends on the desired strength of tubular profiles 8 or posts 4 in the light of the loading thereof when a vehicle is located on the vehicle elevator. FIG. 2 already shows schematically a lock in the form of rods extending along cylinder 10 and having mutually engaging toothings. Such a lock can be provided in the shown manner or in other random manner. Kinematic reversal of the fixed and rotatable connections of the cylinder and the pull rod(s) to rotation shaft 11 is further possible, i.e. the pull rod(s) will then be arranged fixedly on shaft 11 and the cylinder is mounted for rotation round and on shaft 11 within a relatively small range compared to the known art.

The invention claimed is:

1. A vehicle elevator, comprising:

(a) at least one carrier with a length direction for carrying a load thereon; and (b) a lift connected to the carrier at a position under the carrier, wherein the lift comprises at least two rotating components in at least one line of assembly and a rotation shaft, wherein the at least two rotating components are mounted together on the rotation shaft, which extends along the line of assembly, and the rotation shaft, is rotatably connected to the carrier by bearing blocks disposed at each end of the rotation shaft and supports associated with each of the bearing blocks, wherein one of the at least two rotating components is rotatably mounted on the rotation shaft and another of the at least two rotating components is fixedly mounted on the rotation shaft wherein the lift comprises at least one half-scissor construction, wherein the rotating components comprise an extensible drive element and a pull rod, and wherein the extensible drive element is fixedly mounted on the rotation shaft and the pull rod is bearing-mounted on the rotation shaft.

2. The vehicle elevator as claimed in claim 1, wherein the drive element comprises a cylinder.

3. The vehicle elevator as claimed in claim 2, wherein the cylinder is connected fixedly to the rotation shaft.

4. The vehicle elevator as claimed in claim 2, wherein the half-scissor construction further comprises a post.

5. The vehicle elevator as claimed in claim 4, wherein a slide block is arranged on the outer end of the post directed toward the carrier.

6. The vehicle elevator as claimed in claim 5, further including a guide track formed on the carrier at a distance from the line of assembly for guiding the movement of a substantially linearly movable component of the lift.

7. The vehicle elevator as claimed in claim 6, wherein the post is connected for substantially linear movement to the guide track.

8. The vehicle elevator as claimed in claim 7, wherein the slide block and the guide track are associated for the substantially linear movement.

9. The vehicle elevator as claimed in claim 8, wherein the guide track is open in the lengthwise direction, at least at the end directed toward the line of assembly.

10. The vehicle elevator as claimed in claim 1, wherein at least the pull rod is mounted rotatably on the rotation shaft.

11. The vehicle elevator as claimed in claim 1, wherein in the assembled position the rotation shaft is enclosed in a bearing-mounted manner between a set of assembly elements arranged on the carrier.

12. The vehicle elevator as claimed in claim 1, further including bearing blocks arranged pre-mounted on either side of the rotation shaft.

13. The vehicle elevator as claimed in claim 1, wherein at least one of the bearings and bearing blocks is a slide bearing.

14. The vehicle elevator as claimed in claim 13, wherein the slide bearing comprises plastic.

* * * * *

UNITED STATES PATENT AND TRADEMARK OFFICE

CERTIFICATE OF CORRECTION

PATENT NO. : 8,496,090 B2
APPLICATION NO. : 12/305562
DATED : July 30, 2013
INVENTOR(S) : Jan Berends It is certified that error appears in the above-identified patent and that said Letters Patent is hereby corrected as shown below:

In the Claims

Column 5, Line 46, Claim 1, after "shaft" delete ","

Signed and Sealed this
Fifth Day of November, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,496,090 B2
APPLICATION NO. : 12/305562
DATED : July 30, 2013
INVENTOR(S) : Jan Berends It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 943 days.

Signed and Sealed this
Fifteenth Day of September, 2015

Michelle K. Lee

Michelle K. Lee
*Director of the United States Patent and Trademark Office*